US008475145B2

(12) United States Patent
Den Toonder et al.

(10) Patent No.: US 8,475,145 B2
(45) Date of Patent: Jul. 2, 2013

(54) MICRO-FLUIDIC SYSTEMS BASED ON ACTUATOR ELEMENTS

(75) Inventors: Jacob Marinus Jan Den Toonder, Eindhoven (NL); Menno Willem Jose Prins, Eindhoven (NL); Hendrik Roelof Stapert, Eindhoven (NL); Dirk Jan Broer, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1219 days.

(21) Appl. No.: 11/816,537

(22) PCT Filed: Feb. 8, 2006

(86) PCT No.: PCT/IB2006/050411

§ 371 (c)(1),
(2), (4) Date: Aug. 17, 2007

(87) PCT Pub. No.: WO2006/087655

PCT Pub. Date: Aug. 24, 2006

(65) Prior Publication Data

US 2008/0170936 A1 Jul. 17, 2008

(30) Foreign Application Priority Data

Feb. 21, 2005 (EP) ..... 05101291

(51) Int. Cl.
*F04B 35/04* (2006.01)

(52) U.S. Cl.
USPC ..... 417/423.1; 417/436; 422/50

(58) Field of Classification Search
USPC ..... 417/436, 423.1; 137/255; 422/50
See application file for complete search history.

(56) References Cited

U.S. PATENT DOCUMENTS

| | | | | |
|---|---|---|---|---|
| 4,395,719 | A | 7/1983 | Majewski et al. | |
| 5,350,966 | A | 9/1994 | Culp | |
| 6,485,273 | B1 | 11/2002 | Goodwin-Johansson | |
| 7,189,358 | B2 * | 3/2007 | Beach et al. | 422/68.1 |
| 2003/0231967 | A1 | 12/2003 | Najafi et al. | |
| 2006/0069425 | A1 * | 3/2006 | Hillis et al. | 623/1.16 |

FOREIGN PATENT DOCUMENTS

| | | | |
|---|---|---|---|
| EP | 1109232 | A1 | 6/2001 |
| EP | 1219834 | A1 | 7/2002 |

OTHER PUBLICATIONS

Akata, et al., Fabrication and Operation of Polymide Bimorph Actuators for Ciliary Motion System, Journal of Microelectromechanical Systems, vol. 2, No. 4 Dec. 1993 pp. 146-150.*

Tabata O, et al: "Ciliary Motion Acuator", Proceedings of the IEEE 14th. Annual International Conference on Microelectromechanical Systems, vol. Conf. 14, pp. 405-408, 2001, XP010534634.

(Continued)

*Primary Examiner* — Charles Freay
*Assistant Examiner* — Patrick Hamo

(57) ABSTRACT

The present invention provides micro-fluidic systems, a method for the manufacturing of such a micro-fluidic system and a method for controlling or manipulating a fluid flow through micro-channels of a such a micro-fluidic system. Herefore, an inner side of a wall of a microchannel is provided with actuator elements which can change shape and orientation as a response to an external stimulus. Through this change of shape and orientation the flow of a fluid through a microchannel may be controlled and manipulated.

14 Claims, 7 Drawing Sheets

OTHER PUBLICATIONS

John Blake; "A Model for the Micro-Structure in Ciliated Organisms", J. Fluid Mech., vol. 55, Part 1, pp. 1-23, 1972.

Bar-Cohen: "Electroactive Polymer (EAP) Actuators as Artificial Muscles", Ed., SPIE Press, 2004.

* cited by examiner

MICRO-FLUIDIC SYSTEMS BASED ON ACTUATOR ELEMENTS

The present invention relates to micro-fluidic systems, to a method for the manufacturing of such a micro-fluidic system and to a method for controlling or manipulating a fluid flow through micro-channels of such a micro-fluidic system. The micro-fluidic systems may be used in biotechnological and pharmaceutical applications and in micro-channel cooling systems in microelectronics applications. Micro-fluidic systems according to the present invention are compact, cheap and easy to process.

Microfluidics relates to a multidisciplinary field comprising physics, chemistry, engineering and biotechnology that studies the behaviour of fluids at volumes thousands of times smaller than a common droplet. Microfluidic components form the basis of so-called "lab-on-a-chip" devices or biochip networks, that can process microliter and nanoliter volumes of fluid and conduct highly sensitive analytical measurements. The fabrication techniques used to construct microfluidic devices are relatively inexpensive and are amenable both to highly elaborate, multiplexed devices and also to mass production. In a manner similar to that for microelectronics, microfluidic technologies enable the fabrication of highly integrated devices for performing several different functions on a same substrate chip.

Micro-fluidic chips are becoming a key foundation to many of today's fast-growing biotechnologies, such as rapid DNA separation and sizing, cell manipulation, cell sorting and molecule detection. Micro-fluidic chip-based technologies offer many advantages over their traditional macrosized counterparts. Microfluidics is a critical component in, amongst others, gene chip and protein chip development efforts.

In all micro-fluidic devices, there is a basic need for controlling the fluid flow, that is, fluids must be transported, mixed, separated and directed through a micro-channel system consisting of channels with a typical width of about 0.1 mm. A challenge in microfluidic actuation is to design a compact and reliable micro-fluidic system for regulating or manipulating the flow of complex fluids of variable composition, e.g. saliva and full blood, in micro-channels. Various actuation mechanisms have been developed and are at present used, such as, for example, pressure-driven schemes, microfabricated mechanical valves and pumps, inkjet-type pumps, electro-kinetically controlled flows, and surface-acoustic waves.

The application of micro-electro-mechanical systems (MEMS) technology to microfluidic devices has spurred the development of micro-pumps to transport a variety of liquids at a large range of flow rates and pressures.

In US 2003/0231967, a micro-pump assembly 11 is provided for use in micro-gas chromatograph and the like, for driving a gas through the chromatograph. The micro-pump assembly 11, which is illustrated in FIG. 1, includes a micro-pump 22 having a series arrangement of micromachined pump cavities, connected by micro-valves 24. A shared pumping membrane divides the cavity into top and bottom pumping chambers. Both of the pumping chambers are driven by the shared pumping membrane, which may be a polymer film such as a parylene film. Movement of the pumping membrane and control of the shared micro-valve are synchronized to control flow of fluid through the pump unit pair in response to a plurality of electrical signals.

The assembly 11 furthermore comprises an inlet tube 26 and an outlet tube 28. Pumping operation is thus triggered electrostatically by pulling down pump and valve membranes at a certain cycle. Through scheduling the electrical signal in a specific way, one can send gas in one direction or reverse. The frequency at which the pump system is driven determines the flow rate of the pump. By having electrodes on both sides, an electrostatically driven membrane easily overcomes mechanical limitations of vibration and damping from resistant air movement throughout holes and cavities.

The micro-pump assembly 11 of US 2003/0231967 is an example of a membrane-displacement pump, wherein deflection of micro-fabricated membranes provides the pressure work for the pumping of liquids.

A disadvantage, however, of using the micro-pump assembly 11 of US 2003/0231967, and of using micro-pumps in general, is that they have to be, in some way, integrated into micro-fluidic systems. This means that the size of the micro-fluidic systems will increase. It would therefore be useful to have a micro-fluidic system which is compact and cheap, and nevertheless easy to process.

It is an object of the present invention to provide an improved micro-fluidic system and method of manufacturing and operating the same. Advantages of the present invention can be at least one of being compact, cheap and easy to process.

The above objective is accomplished by a method and device according to the present invention.

Particular and preferred aspects of the invention are set out in the accompanying independent and dependent claims. Features from the dependent claims may be combined with features of the independent claims and with features of other dependent claims as appropriate and not merely as explicitly set out in the claims.

In a first aspect, the present invention provides a micro-fluidic system comprising at least one micro-channel having a wall with an inner side, wherein the micro-fluidic system furthermore comprises:

- a plurality of ciliary actuator elements attached to said inner side of said wall, each ciliary actuator element having a shape and an orientation, and
- means for applying stimuli to said plurality of ciliary actuator elements so as to cause a change in their shape and/or orientation.

Application of stimuli to the plurality of ciliary actuator elements provides a way to locally manipulate the flow of complex fluids in a micro-fluidic system. The actuator elements may be driven or addressed individually or in groups to achieve specific ways of fluid flow.

In a preferred embodiment according to the present invention, the actuator elements may be polymer actuator elements and may for example comprise polymer MEMS. Polymer materials are, generally, tough instead of brittle, relatively cheap, elastic up to large strains (up to 10%) and offer perspective of being processable on large surface areas with simple processes. Therefore, they are particularly suitable for being used to form actuator elements according to the present invention.

The means for applying a stimulus to the plurality of ciliary actuator elements may be one of an electric field generating means (e.g. a current source), an electromagnetic field generating means (e.g. a light source), an electromagnetic radiation means (e.g. a light source), an external or internal magnetic field generating means or a heating means.

In a specific embodiment according to the present invention, the means for applying a stimulus to the ciliary actuator elements may be a magnetic field generating means. The actuator elements may then comprise one of a uniform continuous magnetic layer, a patterned continuous magnetic layer or magnetic particles.

In embodiments according to the invention, the plurality of ciliary actuator elements may be arranged in a first and second row, the first row of actuator elements being positioned at a first position of the inner side of the wall and the second row of actuator elements being positioned at a second position of the inner side of the wall, the first position and the second position being substantially opposite to each other.

In other embodiments of the present invention, the plurality of ciliary actuator elements may be arranged in a plurality of rows of actuator elements which may be arranged to form a two-dimensional array.

In further embodiments of the present invention, the plurality of ciliary actuator elements may be randomly arranged at the inner side of the wall of a microchannel.

In a second aspect according to the invention, a method for the manufacturing of a micro-fluidic system comprising at least one microchannel is provided. The method comprises:

- providing an inner side of a wall of said at least one microchannel with a plurality of ciliary actuator elements, and
- providing means for applying a stimulus to said plurality of ciliary actuator elements.

Providing the ciliary actuator elements may be performed by:

- depositing a sacrificial layer having a length L on the inner side of said wall,
- depositing a actuator material on top of said sacrificial layer,
- releasing said actuator material from said inner side of said wall by completely removing said sacrificial layer.

Removing the sacrificial layer may be performed by an etching step.

According to embodiments of the invention, the method may furthermore comprise providing the ciliary actuator elements with one of a uniform continuous magnetic layer, a patterned continuous magnetic layer or with magnetic particles. The means for applying a stimulus to the ciliary actuator elements may comprise providing a magnetic field generating means.

In a further aspect of the present invention, a method for controlling a fluid flow through a microchannel of a micro-fluidic system is provided. The microchannel has a wall with an inner side. The method comprises:

- providing said inner side of said wall with a plurality of ciliary actuator elements, the actuator elements each having a shape and an orientation,
- applying a stimulus to said actuator elements so as to cause a change in its shape and/or orientation.

In a specific embodiment according to the invention, applying a stimulus to the actuator elements may be performed by applying a magnetic field.

The present invention also includes, in a further aspect, a micro-fluidic system comprising at least one micro-channel having a wall with an inner side and containing a liquid, wherein the micro-fluidic system furthermore comprises:

- a plurality of electroactive polymer actuator elements attached to the inner side of the wall, and
- means for applying stimuli to the plurality of electroactive polymer actuator elements so as to drive the liquid in a direction along the micro-channel.

The electroactive polymer actuator element may comprise a polymer gel, an Ionomeric Polymer-Metal composite (IPMC), or another suitable electroactive polymer material.

The micro-fluidic system according to the invention may be used in biotechnological, pharmaceutical, electrical or electronic applications.

These and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

Figure 1:
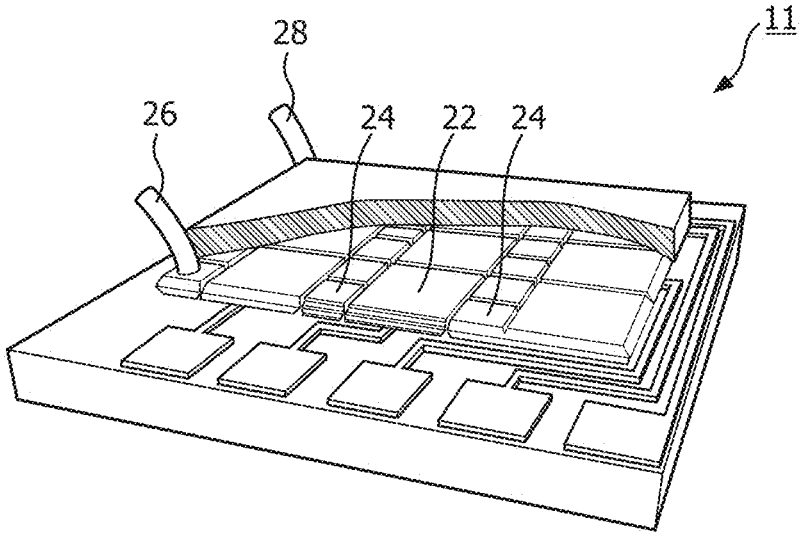
FIG. 1 PRIOR ART
FIG. 1 illustrates a prior art micro-pump assembly.

In the different figures, the same reference signs refer to the same or analogous elements.

The present invention will be described with respect to particular embodiments and with reference to certain drawings but the invention is not limited thereto but only by the claims. Any reference signs in the claims shall not be construed as limiting the scope. The drawings described are only schematic and are non-limiting. In the drawings, the size of some of the elements may be exaggerated and not drawn on scale for illustrative purposes. Where the term "comprising" is used in the present description and claims, it does not exclude other elements or steps. Where an indefinite or definite article is used when referring to a singular noun e.g. "a" or "an", "the", this includes a plural of that noun unless something else is specifically stated.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

In a first aspect, the present invention provides a micro-fluidic system provided with means which allow transportation or (local) mixing or directing of fluids through micro-channels of the micro-fluidic system. In a second aspect, the present invention provides a method for the manufacturing of such a micro-fluidic system. In a third aspect, the present invention provides a method for controlling fluid flow through micro-channels of a micro-fluidic system. The micro-fluidic systems according to the invention are economical and simple to process, while also being robust and compact and suitable for very complex fluids.

A micro-fluidic system according to the invention comprises at least one micro-channel and integrated micro-fluidic elements, also called integrated actuator elements, at an inner side of a wall of the at least one micro-channel. The actuators may be, for example, in any of the embodiments of the present invention unimorphs or bimorphs or multimorphs. According to the invention, the integrated micro-fluidic elements may preferably be based on polymer materials. Suitable materials may be found in the book "Electroactive Polymer (EAP) Actuators as Artificial Muscles", ed. Bar-Cohen, SPIE Press, 2004. However, also other materials may be used for the actuator elements. The materials that may be used to form actuator elements according to the present invention should be such that the formed actuator elements have the following characteristics:

- the actuator element should be compliant, i.e. not stiff,
- the actuator element should be tough, not brittle,
- the actuator elements should respond to a certain stimulus such as e.g. light, an electric field, a magnetic field, etc. by bending or changing shape, and
- the actuator elements should be easy to process by means of relatively cheap processes.

Depending on the type of actuation stimulus, the material that is used to form the actuator elements may have to be functionalized. Considering the first, second and fourth characteristic of the above summarized list, polymers are preferred for at least a part of the actuators. Most types of polymers can be used according to the present invention, except for very brittle polymers such as e.g. polystyrene which are not very suitable to use with the present invention. In some cases, for example in case of electrostatic or magnetic actuation (see further), metals may be used to form the actuator elements or may be part of the actuator elements, e.g. in Ionomeric Polymer-Metal composites (IPMC). For example, for magnetic actuation, FeNi or another magnetic material may be used to form the actuator elements. A disadvantage of metals, however, could be mechanical fatigue and cost of processing.

According to the invention, all suitable materials, i.e. materials that are able to change shape by, for example, mechanically deforming as a response to an external stimulus, may be used. Traditional materials that show this mechanical response, and that may be applied to form actuator elements for use in the methods according to the present invention, may be electro-active piezoelectric ceramics such as, for example, barium titanate, quartz or lead zirconate titanate (PZT). These materials may respond to an applied external stimulus, such as for example an applied electric field, by expanding. However, an important drawback of electro-active ceramics is that they are brittle, i.e. they fracture quite easily. Furthermore, the processing technologies for electro-active ceramics are rather expensive and cannot be scaled up to large surface areas. Therefore, electro-active piezoelectric ceramics may only be suitable in a limited number of cases.

A more recently explored class of responsive materials is that of shape memory alloys (SMA's). These are metals that demonstrate the ability to return to a memorized shape or size when they are heated above a certain temperature. The stimulus here is thus change in temperature. Generally, those metals can be deformed at low temperature and will return to their original shape upon exposure to a high temperature, by virtue of a phase transformation that happens at a critical temperature. Examples of such SMA's may be NiTi or copper-aluminium-based alloys (e.g. CuZnAl and CuAl). Also SMA's have some drawbacks and thus limitations in the number of cases in which these materials may be used to form actuator elements. The alloys are relatively expensive to manufacture and machine, and large surface area processing is not easy to do. Also, most SMA's have poor fatigue properties, which means that after a limited number of loading cycles, the material may fail.

Other materials that can be used include all forms of Electroactive Polymers (EAPs). The may be classified very generally into two classes: ionic and electronic. Electronically activated EAPs include any of electrostrictive (e.g. electrostrictive graft elastomers), electrostatic (dielectric), piezoelectric, magnetic, electrovisco-elastic, liquid crystal elastomer, and ferroelectric actuated polymers. Ionic EAPs include gels such as ionic polymer gels, Ionomeric Polymer-Metal Composites (IPMC), conductive polymers and carbon nanotubes. The materials may exhibit conductive or photonic properties, or be chemically activated, i.e. be non-electrically deformable. Any of the above EAPs can be made to bend with a significant curving response and can be used in the form, for example, of ciliary actuators.

Because of the above, according to the present invention, the actuator elements may preferably be formed of, or include as a part of their construction, polymer materials. Therefore, in the further description, the invention will be described by means of polymer actuator elements. It has, however, to be understood by a person skilled in the art that the present invention may also be applied when other materials than polymers, as described above, are used to form the actuator elements. Polymer materials are, generally, tough instead of brittle, relatively cheap, elastic up to large strains (up to 10%) and offer perspective of being processable on large surface areas with simple processes.

The micro-fluidic system according to the invention may be used in biotechnological applications, such as micro total analysis systems, micro-fluidic diagnostics, micro-factories and chemical or biochemical micro-plants, biosensors, rapid DNA separation and sizing, cell manipulation and sorting, in pharmaceutical applications, in particular high-throughput combinatorial testing where local mixing is essential, and in micro-channel cooling systems e.g. in micro-electronics applications.

In one aspect of the invention, the way in which the micro-actuators, especially polymer micro-actuators according to the invention are envisioned to work, is inspired by nature. Nature knows various ways to manipulate fluids at small scales, i.e. 1-100 micron scales. One particular mechanism found is that due to a covering of beating cilia over the external surface of micro-organisms, such as, for example, paramecium, pleurobrachia, and opaline. Ciliary motile clearance is also used in the bronchia and nose of mammals to remove contaminants. A cilium can be seen as a small hair or flexible rod which in, for example, protozoa may have a typical length of 10 μm and a typical diameter of 0.1 μm, attached to a surface. Apart from a propulsion mechanism for micro-organisms, other functions of cilia are in cleansing of gills, feeding, excretion and reproduction. The human trachea, for example, is covered with cilia that transport mucus upwards and out of the lungs. Cilia are also used to produce feeding currents by sessile organisms that are attached to a rigid substrate by a long stalk. The combined action of the cilia movement with the periodic lengthening and shortening of the stalk induces a chaotic vortex. This results in chaotic filtration behaviour of the surrounding fluid.

Figure 2:
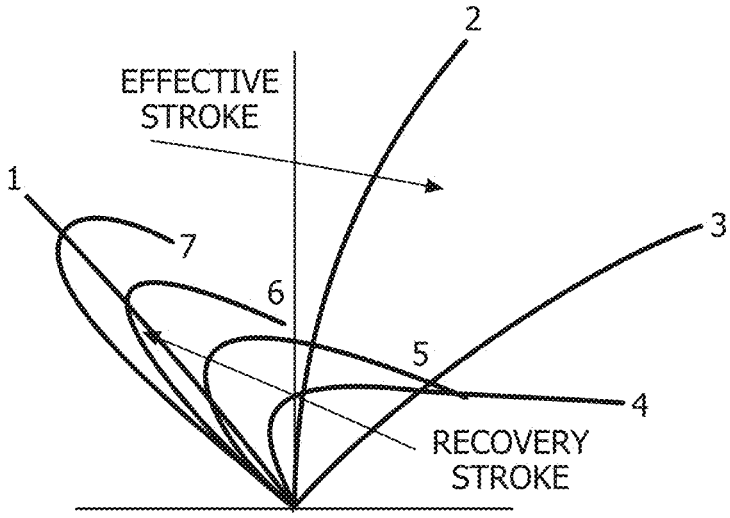
FIG. 2 illustrates an example of a ciliary beat cycle showing the effective and recovery strokes.
Figure 3:
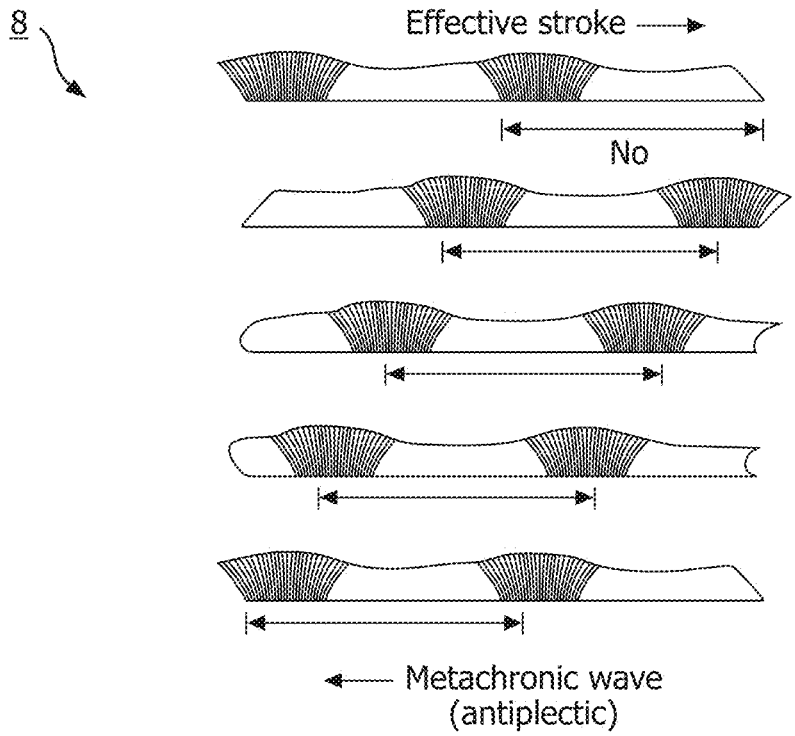
FIG. 3 illustrates a wave of cilia showing their co-ordination in a metachronic wave.

The above discussion illustrates that cilia can be used for transporting and/or mixing fluid in micro-channels. The mechanics of ciliary motion and flow has interested both zoologists and fluid mechanists for many years. The beat of a single cilium can be separated into two distinct phases i.e. a fast effective stroke (curve 1 to 3 of FIG. 2) when the cilium drives fluid in a desired direction and a recovery stroke (curve 4 to 7 of FIG. 2) when the cilium seeks to minimize its influence on the generated fluid motion. In nature, fluid motion is caused by high concentrations of cilia in rows along and across the surface of an organism. The movements of adjacent cilia in one direction are out of phase, this phenomenon is called metachronism. Thus, the motion of cilia appears as a wave passing over the organism. FIG. 3 illustrates such a wave 8 of cilia showing their co-ordination in a metachronic wave. A model that describes the movement of fluid by cilia is published by J. Blake in 'A model for the micro-structure in ciliated organisms', J. Fluid. Mech. 55, p.1-23 (1972). In this article, it is described that the influence of cilia on fluid flow is modelled by representing the cilia as a collection of "Stokeslets" along their centreline, which can be viewed as point forces within the fluid. The movement of these Stokeslets in time is prescribed, and the resulting fluid flow can be calculated. Not only the flow due to a single cilium can be calculated, also that due to a collection of cilia covering a single wall with an infinite fluid layer on top, moving according to a metachronic wave.

The approach a preferred aspect of the present invention makes use of is to mimic the cilia-like fluid manipulation in micro-channels by covering the walls of the micro-channels with "artificial cilia" based on microscopic polymer actuator elements, i.e. polymer structures changing their shape and/or dimension in response to a certain external stimulus. Hence, one aspect of the present invention provides a fluid flow device such as a pump having means for artificial ciliary metachronic activity. In the following description, these microscopic actuator elements such as polymer actuator elements may also be referred to as actuators, e.g. polymer actuators or micro-polymer actuators, actuator elements, micro-polymer actuator elements or polymer actuator elements. It has to be noticed that when any of these terms is used in the further description always the same microscopic actuator elements according to the invention are meant. For example micro-polymer actuator elements or polymer actuators can be set in motion, either individually or in groups, by any suitable external stimulus. This external stimulus may, for example, be an electric field such as e.g. a current, electromagnetic radiation such as e.g. visible light, UV light, infrared light, a magnetic field, a temperature change, a specific chemical species, a pH change or any other suitable means.

Actuator elements formed of materials which can respond to temperature changes, visible and UV light, water, molecules, electrostatic field, magnetic field, electric field, may be used according to the invention. Suitable materials can be identified from the above book by Bar-Cohen. The basic idea of the invention which is based on artificial cilia manipulating fluids on a small scale is independent of the material the actuator means is formed of However, for biomedical applications, for example, light- and magnetic actuation means may be preferred, considering possible interactions with the complex biological fluids that may occur using other materials to form the actuator elements.

Figure 14:
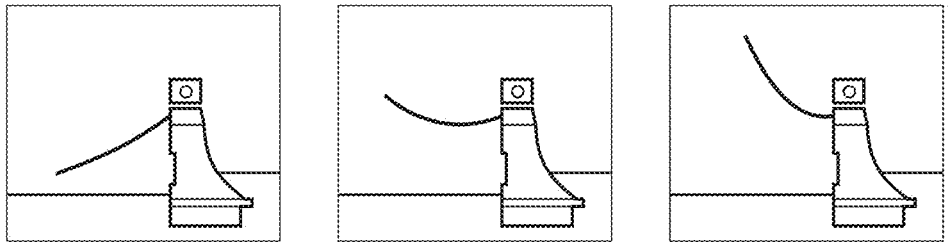
FIG. 14 is an illustration of the working of an Ionomeric Polymer-Metal Composite (IPMC) actuator element, which may include polymers such as e.g. a perfluorcarbonate or a perfluorsulfonate actuator element, according to a further embodiment of the present invention.

In the description, mainly magnetic actuation will be discussed. However, it has to be understood that also other stimuli may be used according to the present invention. For example, electrical stimuli, temperature changes, light, . . . An example of polymer material that may be used for forming actuator elements which are being electrically stimulated may be a ferroelectric polymer, i.e. polyvinylidene fluorine (PVDF). Generally, all suitable polymers with low elastic stiffness and high dielectric constant may be used to induce large actuation strain by subjecting them to an electric field. Other suitable polymers may for example be Ionomeric Polymer-Metal Composite (IPMC) materials or e.g. perfluorsulfonate and perfluorcarbonate. An illustration of the working of such perfluorcarbonate or perfluorsulfonate actuator elements is shown in FIG. 14. Examples of temperature driven polymer materials may be shape memory polymers (SMP's), which are thermally responsive polymer gels.

Figure 4:
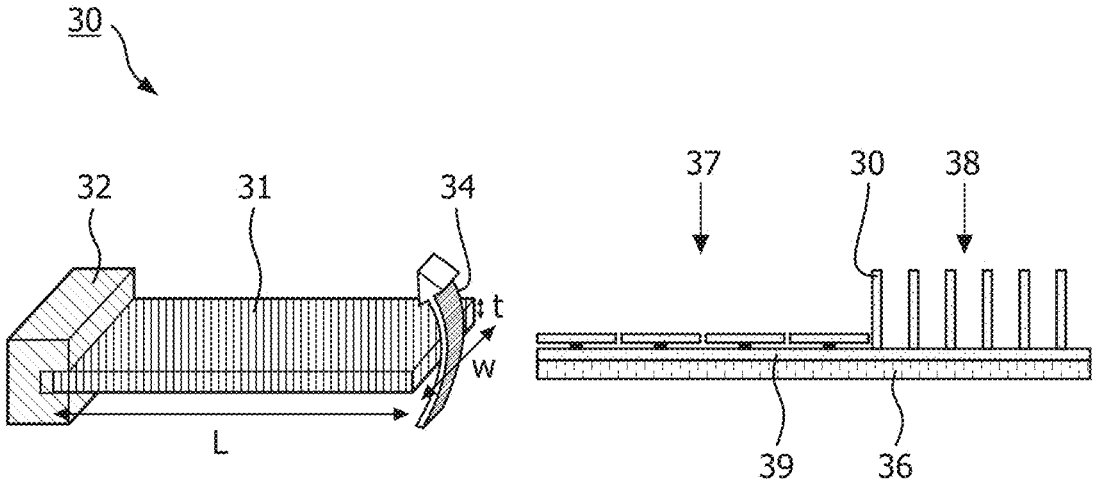
FIG. 4 illustrates a bending polymer MEMS structure according to an embodiment of the present invention and a responsive surface covered with such bending polymer MEMS structure.
Figure 5:
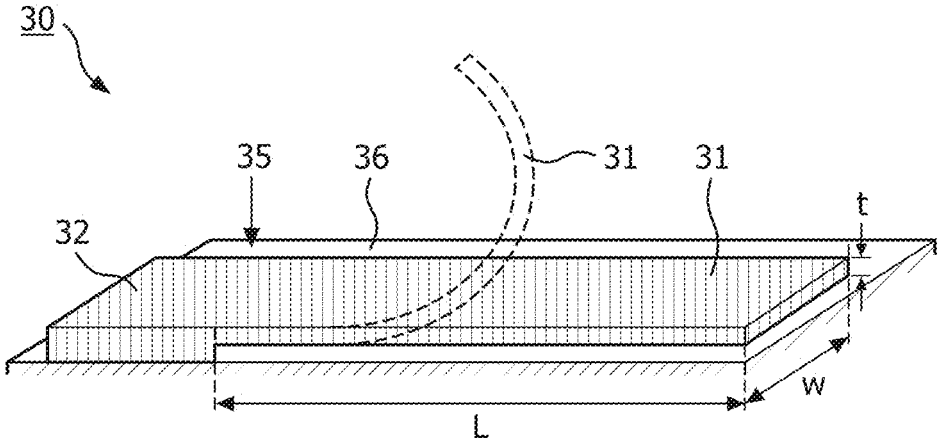
FIG. 5 is a schematic illustration of a single polymer actuator element according to an embodiment of the invention.

FIG. 4 and FIG. 5 illustrate an example of a polymer actuator element 30 according to an embodiment of the present invention. The left hand part of FIG. 4 represents an actuator element 30 which may respond to an external stimulus, such as e.g. an electric or magnetic field or another stimulus, by bending up and down. The right hand part of FIG. 4 illustrates a cross section in a direction perpendicular to an inner side 35 of a wall 36 of a microchannel 33 which is covered with actuator elements 30. The actuator elements 30 in the right hand part of FIG. 4 may respond to an external stimulus by bending from the left to the right. The polymer actuator element 30 comprises a polymer Micro-Electro-Mechanical System or polymer MBMS 31 and an attachment means 32 for attaching the polymer MEMS 31 to a microchannel 33 of the micro-fluidic system. The attachment means 32 can be positioned at a first extremity of the polymer MEMS 31.

The attachment means 32 remains. One obtains a free-standing element (attached at 32) with a gap underneath that has the size of the originally present sacrificial layer and may be obtained by, e.g., standard Microsystems processing.

The polymer MBMS 31 may have the shape of a beam. However, the invention is not limited to beam-shaped MBMS, the polymer actuator element 30 may also comprise polymer MEMS 31 having other suitable shapes, preferably elongate shapes, such as for example the shape of a rod.

An embodiment of how to form an actuator element 30 attached to a micro-channel 33 according to the invention will be described hereinafter.

The actuator elements 30 may be fixed to the inner side 35 of the wall 36 of a microchannel 33 in various possible ways. A first way to fix the actuator elements 30 to the inner side 35 of the wall 36 of a microchannel 33 is by depositing, for example by spinning, evaporation or by another suitable deposition technique, a layer of material out of which the actuator elements 30 will be formed on a sacrificial layer. Therefore, first a sacrificial layer may be deposited on an inner side 35 of a wall 36 of the micro-channel 33. The sacrificial layer may, for example, be composed of a metal (e.g. aluminum), an oxide (e.g. SiOx), a nitride (e.g. SixNy) or a polymer. The material the sacrificial layer is composed of should be such that it can be selectively etched with respect to the material the actuating element is formed of and may be deposited on an inner side 35 of a wall 36 of the micro-channel 33 over a suitable length. In some embodiments the sacrificial layer may, for example, be deposited over the whole surface area of the inner side 35 of the wall 35 of a microchannel 33, typically areas in the order of several cm. However, in other embodiments, the sacrificial layer may be deposited over a length L, which length L may then be the same length as the length of the actuator element 30, which may typically be between 10 to 100 μm. Depending on the material used, the sacrificial layer may have a thickness of between 0.1 and 10 μm.

In a next step, a layer of polymer material, which later will form the polymer MEMS 31, is deposited over the sacrificial layer and next to one side of the sacrificial layer. Subsequently, the sacrificial layer may be removed by etching the sacrificial layer underneath the polymer MBMS 31. In that way, the polymer layer is released from the inner side 35 of the wall 36 over the length L (as illustrated in FIG. 4), this part forming the polymer MEMS 31. The part of the polymer layer that stays attached to the inner side 35 of the wall 36 forms the attachment means 32 for attaching the polymer MEMS to the micro-channel 33, more particularly to the inner side 35 of the wall 36 of the micro-channel 33.

Another way to form the actuator element 30 according to the present invention may be by using patterned surface energy engineering of the inner side 35 of the wall 36 before applying the polymer material. In that case, the inner side 35 of the wall 36 of the microchannel 33 on which the actuator elements 30 will be attached is patterned in such a way that regions with different surface energies are obtained. This can be done with suitable techniques such as, for example, lithography or printing. Therefore, the layer of material out of which the actuator elements 30 will be constructed is deposited and structured, each with suitable techniques known by a person skilled in the art. The layer will attach strongly to some areas of the inner side 35 of the wall 36 underneath, further referred to as strong adhesion areas, and weakly to other areas of the inner side 35 of the wall 36, further referred to as weak adhesion areas. It may then be possible to get spontaneous release of the layer at the weak adhesion areas, whereas the layer will remain fixed at the strong adhesion areas. The strong adhesion areas may then form the attachment means 32. In that way it is thus possible to obtain self-forming free-standing actuator elements 30.

The as-processed elements 30 need not to be in a direction substantially parallel to the channel wall 36, as is suggested in all the figures of the present application.

The polymer MEMS 31 may, for example, comprise an acrylate polymer, a poly(ethylene glycol) polymer comprising copolymers, or may comprise any other suitable polymer. Preferably, the polymers the polymer MEMS 31 are formed of should be biocompatible polymers such that they have minimal (bio)chemical interactions with the fluid in the micro-channels 33 or the components of the fluid in the micro-channels 33. Alternatively, the polymer actuator elements 30 may be modified so as to control non-specific adsorption properties and wettability. The polymer MEMS 31 may, for example, comprise a composite material. For example, it may comprise a particle-filled matrix material or a multilayer structure. It could also be mentioned that "liquid crystal polymer network materials" may be used in accordance with the present invention.

In a non-actuated state, i.e. when no external stimuli are applied to the actuator element 30, the polymer MEMS 31 which, in a specific example, may have the form of a beam, are either curved or straight. An external stimulus, such as, for example, an electric field such as a current, electromagnetic radiation such as light, a magnetic field, a temperature change, presence of a specific chemical species, a pH change or any other suitable means, applied to the polymer actuator elements 30, causes them to bend or straighten out or in other words, causes them to be set in motion. The change in shape of the actuator elements 30 sets the surrounding fluid, which is present in the micro-channel 33 of the micro-fluidic system, in motion. In FIG. 4 the bending of the polymer MEMS 31 is indicated by arrow 34 and in FIG. 5 this is illustrated by the dashed line. Due to the fixation to the wall 36 of one extremity of the actuation element 30, the movement obtained resembles that of the movement of the cilia described earlier.

Figure 6:
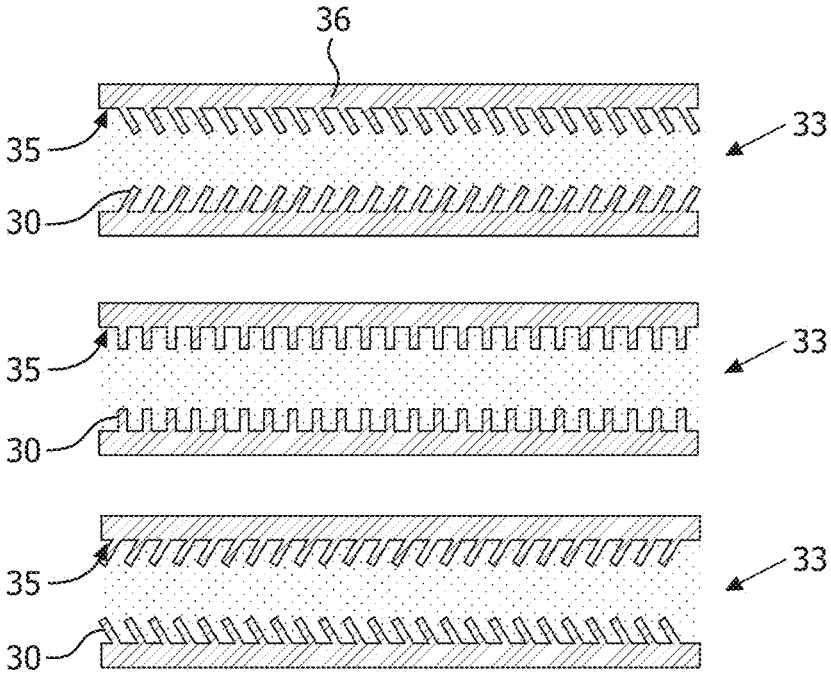
FIG. 6 is a schematic illustration of cross-sections of a microchannel having the inner side of its wall covered with straight polymer actuator elements according to an embodiment of the invention.

According to the above-described aspect of the invention, the polymer MEMS 31 may have a length L of between 10 and 200 μm and may typically be 100 μm, and may have a width w of between 2 and 30 μm, typically 20 gm. The polymer MEMS 31 may have a thickness t of between 0.1 and 2 μm, typically 1 μm. FIG. 6 illustrates an embodiment of a micro-channel 33 provided with polymer actuating means according to the present invention. In this embodiment, an example of a design of part of a micro-fluidic system is shown. A cross-section of a micro-channel 33 is schematically depicted. According to this first embodiment of the invention, the inner sides 35 of the walls 36 of the micro-channels 33, may be covered with a plurality of straight polymer actuator elements 30. For the clarity of the drawings, only the polymer MEMS part 31 of the actuator element 30 is shown. The polymer MEMS 31 can move back and forth, under the action of an external stimulus applied to the actuator elements 30. This external stimulus may, as already discussed, for example be an electric field, electromagnetic radiation, a temperature change, a magnetic field, or other suitable means. The actuator elements 30 may comprise polymer MEMS 31 which may e.g. have a rod-like shape or a beam-like shape, with their width extending in a direction coming out of the plane of the drawing.

The actuator elements 30 at the inner side 35 of the walls 36 of the micro-channels 33 may, in embodiments of the invention, be arranged in one or more rows. As an example only, the actuator elements 30 may be arranged in two rows of actuator elements 30, i.e. a first row of actuator elements 30 on a first position at the inner side 35 of the wall 36 and a second row of actuator elements 30 at a second position of the inner side 35 of the wall 36, the first and second position being substantially opposite to each other. In other embodiments of to the present invention, the actuator elements 31 may also be arranged in a plurality of rows of actuator elements 30 which may be arranged to form, for example, a two-dimensional array. In still further embodiments, the actuator elements 30 may be randomly positioned at the inner side 35 of the wall 36 of a micro-channel 33.

To be able to transport fluid in a certain direction, for example from the left to the right in FIG. 6, the movement of the polymer actuator elements 30 must be asymmetric. That is, the nature of the "beating" stroke (as explained in FIG. 2) should be different from that of the "recovery" stroke (see FIG. 2). This may be achieved by a fast beating stroke and a much slower recovery stroke.

For a pumping device the motion of the polymer actuator elements is provided by a metachronic actuator means. This can be done by providing means for addressing the actuator elements 30 either individually or row by row. In case of, for example, electrostatic actuation this may be achieved by a patterned electrode structure that is part of a wall 36 of a microchannel 33. The patterned electrode structure may comprise a structured film, which film may be a metal or another suitable conductive film. Structuring of the film may be done by, for example, using lithography. The patterned structures can be individually addressed. The same may be applied for magnetically actuated structures. Patterned conductive films that are part of the channel wall structure may make it possible to create local magnetic fields so that actuator elements 30 can be addressed individually or in rows. The same approach may be used for actuator elements 30 which are responsive to heat. In that case, the conductive patterns function as local heating elements by resistive heating. As for actuator elements 30 responsive to light, a pixelated light source may be integrated in the channel wall 36 underneath the actuator elements 30 (very much like a display), and of which the pixels can be switched on or off individually.

In all above described cases, individual or row-by-row stimulation of the actuator elements 30 is possible since the wall 36 of the microchannel 33 comprises a structured pattern through which the stimulus is activated. By proper addressing in time, a co-ordinated stimulation, for example, in a wave-like manner, is made possible. Non-co-ordinated or random actuator means, symplectic metachronic actuator means and antiplectic metachronic actuator means are included within the scope of the present invention (see below).

In the example shown in FIG. 6, all polymer actuator elements 30, also those on different rows, move simultaneously. The functioning of the polymer actuators 30 may be improved by individual addressing of the actuator elements 30 or of the rows of actuator elements 30, so that their movement is out of phase. In, for example, electrically stimulated actuator elements 30, this may be performed by using patterned electrodes which may be integrated into the walls 36 of the micro-channel 33 (not shown in the drawing). Thus, the motion of actuator elements 30 appears as a wave passing over the inner side 35 of the wall 36 of the micro-channel 33, similar as the wave movement illustrated in FIG. 3. The means for providing the movement may generate a wave movement that may pass in the same direction as the effective beating movement ("symplectic metachronism") or in the opposite direction ("antiplectic metachronism").

To, for example, obtain local mixing in a micro-channel 33 of a micro-fluidic system, the motion of the actuator elements 30 may be deliberately made uncorrelated, i.e. some actuator elements 30 may move in one direction whereas other actuator elements 30 may move in the opposite direction in an uncorrelated way so as to create local chaotic mixing. Vortices may be created by opposite movements of the actuator elements 30 on e.g. opposite positions of the walls 36 of the micro-channel 33.

Figure 7:
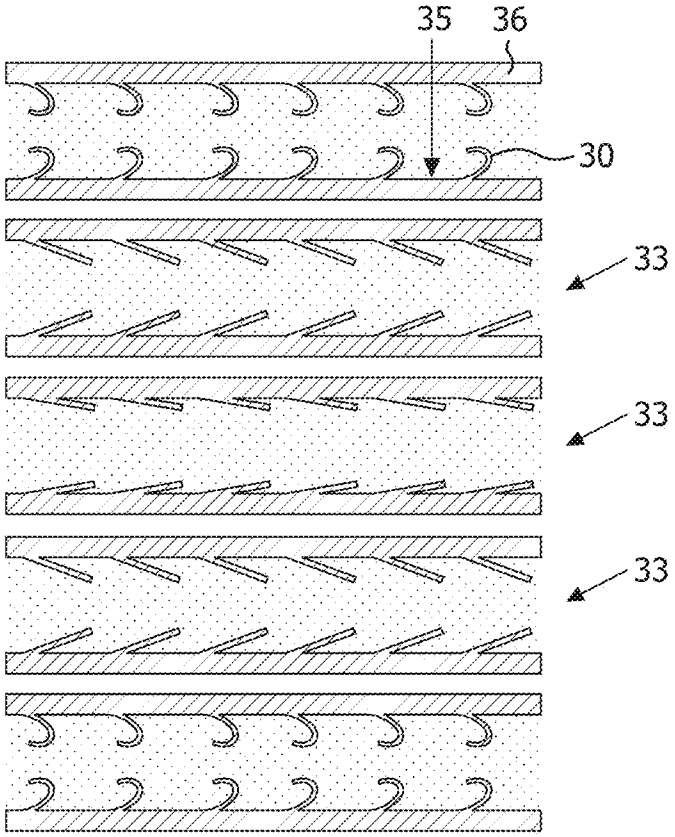
FIG. 7 is a schematic illustration of cross-sections of a microchannel having the inner side of its wall covered with polymer actuator elements that curl up and straighten out according to another embodiment of the invention.

A further embodiment of a micro-fluidic channel 33 provided with actuator elements according to the present invention is schematically illustrated in FIG. 7. The inner side 35 of the walls 36 of the micro-channels 33 may, in this embodiment, be covered with polymer actuator elements 30 that can be changed from a curled shape into a straight shape. This change of shape can be obtained in different ways. For example, a change of shape of the actuator element 30 can be obtained by controlling the microstructure of the actuator element 30, for example by introducing a gradient in effective material stiffness over the thickness of the actuator element 30, wherein the top (or bottom) of the actuator elements is stiffer than the bottom (or top). This will cause "asymmetric bending", i.e. the actuator element 30 will bend more easily one way than the other. Change of shape of the actuator element 30 may also be achieved by controlling the driving of the stimulus, such as a time-and/or space-dependent magnetic field in case of magnetic actuation, see FIG. 13. Again, for the clarity of the drawings, only the polymer MEMS part 31 of the actuator elements 30 is shown. In this embodiment, an asymmetric movement of the actuator elements 30 may be obtained which may be further enhanced by moving fast in one direction and slow in the other, e.g. a fast movement from the curled to the straight shaped and a slow movement from the straight to the curled shape, or vice versa. The polymer actuator elements 30 adapted for changing shape may comprise polymer MEMS 31 with e.g. a rod-like shape or with a beam-like shape. The actuator elements 30 may, according to embodiments of the invention, be arranged in one or more rows, e.g. a first and a second row at the inner side 35 of the wall 36 of the micro-channel 33, the first and second row being positioned at substantially opposite positions at the inner side 35 of the wall 36. In other embodiments of the invention, the actuator elements 30 may be positioned in a plurality of rows of actuator elements 30 which may be arranged to form, for example, a two-dimensional array. In still further embodiments of the invention, the actuator elements 30 may be randomly arranged at the inner side 35 of the wall 36 of a micro-channel 36. By individually addressing the actuator elements 30 or a row of actuator elements 30, a wave-like movement, an otherwise correlated movement, or an uncorrelated movement may be generated that can be advantageous in transporting or mixing fluids, or creating vortices, all inside the micro-channel 33.

Figure 8:
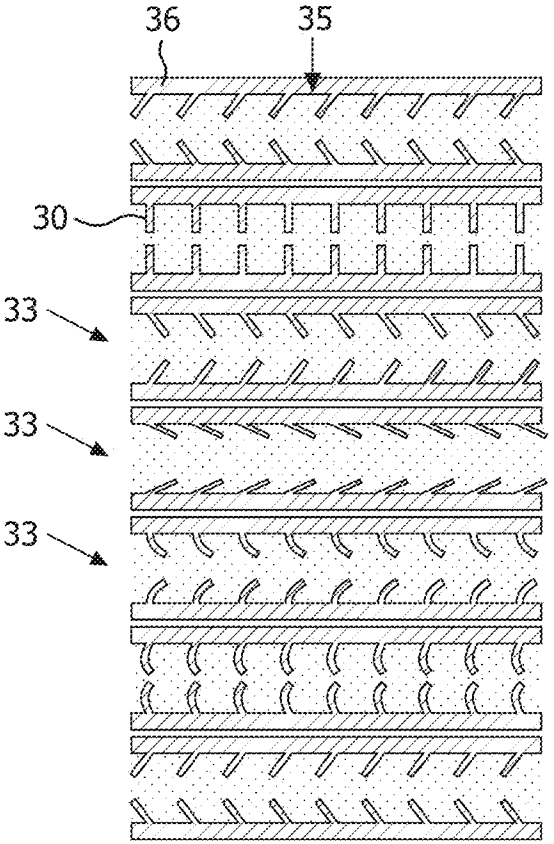
FIG. 8 is a schematic illustration of cross-sections of a microchannel having the inner side its wall covered with polymer actuator elements that move back and forth asymmetrically according to still another embodiment of the invention.

A further embodiment of the present invention is illustrated in FIG. 8. The inner side 35 of the walls 36 of the micro-channel 33 may, in this embodiment, be covered with actuator elements 30 that undertake an asymmetric movement similar to that of naturally occurring cilia as was illustrated in FIG. 3. This may be achieved by inducing a change of molecular order in the actuator elements 30 from one side to the other. In other words, a gradient in material structure over the thickness t of the actuator elements 30 is obtained. This gradient may be achieved in various ways. In case of liquid crystal polymer networks, the orientation of the liquid crystal molecules can be varied from top to bottom of the layers by controlled processing, for example by using a process which is used for amongst others, liquid crystal (LC) display processing. Another possible way to achieve such a gradient is by building or depositing the layer the actuator element 30 is formed of from different layers of different materials with varying stiffness.

The asymmetric movement may be further enhanced by moving fast in one direction and slow in the other. The actuator elements 30 may comprise polymer MEMS 31 with an elongate shape such as a rod-like shape or a beam-like shape. The actuator elements 30 may, in embodiments of the invention, be arranged at the inner side 35 of the walls 36 in one or more rows, e.g. in a first and a second row, for example one row of actuator elements 30 on each of two substantially opposite positions on the inner side 35 of the wall 36. In other embodiments of the present invention, a plurality of rows of actuator elements 30 may be arranged to form, for example, a two-dimensional array. In still further embodiments, the actuator elements 30 may be randomly arranged at the inner side 35 of the wall 36 of a micro-channel 33. By individual addressing of the actuator elements 30 or by individual addressing of rows of actuator elements 30, a wave-like movement, an otherwise correlated movement, or an uncorrelated movement may be generated that can be advantageous in transporting and mixing of fluid, or in creating vortices.

In FIG. 6 to 8 three examples of possible designs of micro-fluidic systems according to embodiments of the present invention are shown, which illustrate embodiments using polymer actuator elements 30 integrated on the inner side 35 of the walls 36 of micro-channels 33 to manipulate fluid in micro-channels 33. It should, however, be understood by a person skilled in the art that other designs are conceivable and that the specific embodiments described are not limiting to the invention.

Applying Blake's model (J. Blake in 'A model for the micro-structure in ciliated organisms', J. Fluid. Mech. 55, p.1-23 (1972)) to the polymer actuator elements 30 as described in embodiments of the present invention, it can be estimated that by covering a wall 36 of a micro-channel 33 with the actuator elements 30, a fluid flow with a velocity of between 0 and several mm/s, depending on the type of actuator elements 30 and the fluid used, can be induced by controlling the movement of the actuator elements 30 as described in the above embodiments. Taking, for example, water as a model fluid, it is also possible to compute that a load of 1 nN and a bending moment of 10-13 Nm must be applied to the actuator elements 30 to reach this velocity. These are very small values, which can easily be obtained by the small components used in micro-fluidic systems. The above-described analysis proves that considerable velocities can be produced using the micro-fluidic systems according to embodiments of the present invention. Therefore, if the polymer MEMS 31 according to embodiments of the invention are designed so as to make a movement resembling that of cilia, walls 36 of micro-channels 33 comprising such polymer MEMS 31 will be very efficient in transporting and/or mixing of fluids and in creating vortices.

An advantage of the approach according to the present invention, in the specific case of polymer actuator elements 30, is that the means which takes care of fluid manipulation, i.e. the at least one polymer actuator element 30, is completely integrated in the micro-fluidic channel system and allows to obtain large shape changes that are required for micro-fluidic applications, so that no external pump or micro-pump is needed. Hence, the present invention provides compact micro-fluidic systems. Another, perhaps even more important advantage, is that the fluid can be controlled locally in the micro-channels 33 by addressing all actuator elements 30 at the same time or by addressing only at least one predetermined actuator element 30 at a time. Therefore, fluid can be transported, recirculated, mixed, or separated right at a required, predetermined position. A further advantage of the present invention is that the use of polymers for the actuator elements 30 may lead to cheap processing technologies such as, for example, printing or embossing techniques, or single-step lithography.

Furthermore, the micro-fluidic system according to the present invention is robust, this means that if a single or a few actuator elements 30 fail to work properly, that does not largely disturb the performance of the overall micro-fluidic system.

The microfluidic systems according to the invention may, for example, be used in biotechnological applications such as biosensors, rapid DNA separation and sizing, cell manipulation and sorting, in pharmaceutical applications, in particular high-throughput combinatorial testing where local mixing is essential and in microchannel cooling systems in microelectronics applications.

For example, the micro-fluidic system of the present invention may be used in biosensors for, for example, the detection of at least one target molecule, such as proteins, antibodies, nucleic acids (e.g. DNR, RNA), peptides, oligo- or polysaccharides or sugars, in, for example, biological fluids, such as saliva, sputum, blood, blood plasma, interstitial fluid or urine. Therefore, a small sample of the fluid (e.g. a droplet) is supplied to the device, and by manipulation of the fluid within a micro-channel system, the fluid is let to the sensing position where the actual detection takes place. By using various sensors in the micro-fluidic system according to the present invention, different types of target molecules may be detected in one analysis run.

Hereinafter, a specific, non-limiting embodiment of the present invention will be described. In this specific embodiment, the polymer actuator elements 30 may be rotated or changed in shape by applying a magnetic field. Generating complex time-dependent magnetic field will enable complex moving shapes of the actuators, so that their fluid manipulation effectiveness can be optimized.

In this specific embodiment a change in orientation and/or shape of the actuator elements 30 may be achieved by applying a magnetic field to the actuator elements 30. This is in particular favourable for biomedical applications with complex and variable fluids.

Figure 9:
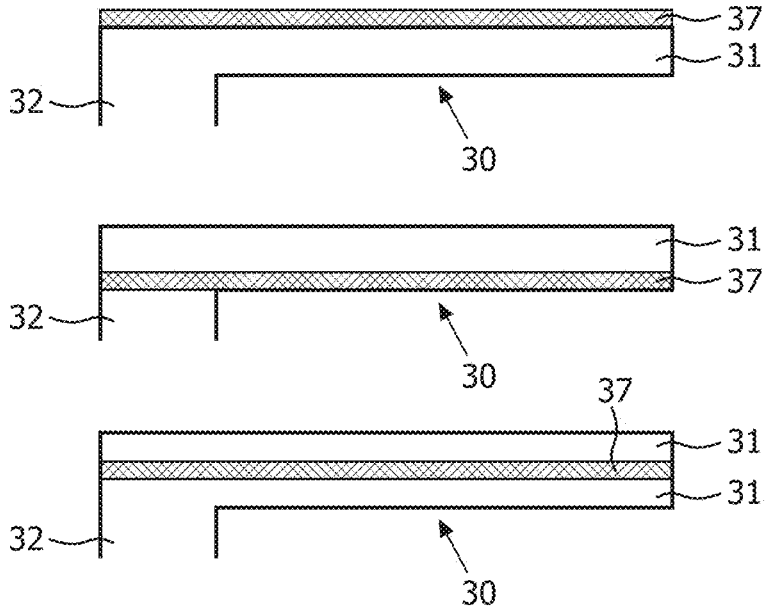
FIG. 9 illustrates a polymer actuator element comprising a continuous magnetic layer according to embodiments of the invention.

To be able to actuate the actuator elements 30 by applying a magnetic field, the actuator elements 30 must be provided with magnetic properties. One way to provide a polymer actuator element 30 with magnetic properties is by incorporating a continuous magnetic layer 37 in the polymer actuator element 30, as shown in the different embodiments represented in FIG. 9. The actuator elements 30 with magnetic properties will in the further description be referred to as magnetic actuator elements 30. The continuous magnetic layer 37 may be positioned at the top (upper drawing of FIG. 9) or at the bottom of the actuator element 30 (drawing in the middle of FIG. 9), or may be situated in the centre of the actuator element 30 (lower drawing of FIG. 9). The position of the continuous magnetic layer 37, together with its thermo-mechanical properties, determine the "natural" or non-actuated shape of the magnetic actuator element 30, i.e. flat, curled upward or curled downward. The continuous magnetic layer 37 may, for example, be an electroplated permalloy (e.g. Ni—Fe) and may, for example, be deposited as a uniform layer. The continuous magnetic layer 37 may have a thickness of between 0.1 and 10 μm. The direction of easy magnetization may be determined by the deposition process and may, in the example given, be the 'in-plane' direction. Instead of a uniform layer, the continuous magnetic layer 37 may also be patterned (not shown in the drawings) to increase the compliance and ease of deformation of the magnetic actuator elements 30.

Figure 10:
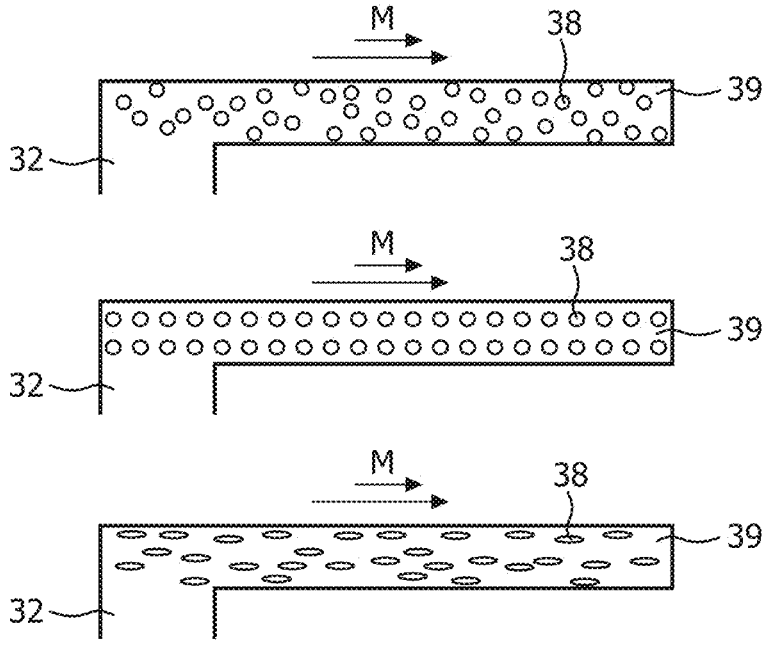
FIG. 10 illustrates a polymer actuator element comprising magnetic particles according to embodiments of the present invention.

Another way to achieve a magnetic actuator element 30 is by incorporating magnetic particles 38 in the polymer actuator element 30. The polymer may in that case function as a 'matrix' in which the magnetic particles 38 are dispersed, as is illustrated in FIG. 10, and will further be referred to as polymer matrix 39. The magnetic particles 38 may be added to the polymer in solution or may be added to monomers that, later on, then can be polymerized. In a subsequent step, the polymer may then be applied to the inner side 35 of the wall 36 of the micro-channel 33 by any suitable method, e.g. by a wet deposition technique such as e.g. spin-coating. The magnetic particles 38 may for example be spherical, as illustrated in the upper two drawings in FIG. 10 or may be elongate, e.g. rod-shaped, as illustrated in the lower drawing in FIG. 10. The rod-shaped magnetic particles 38 may have the advantage that they may automatically be aligned by shear flow during the deposition process. The magnetic particles 38 may be randomly arranged in the polymer matrix 39, as illustrated in the upper and lower drawing of FIG. 10, or they may be arranged or aligned in the polymer matrix 39 in a regular pattern, e.g. in rows, as is illustrated in the drawing in the middle of FIG. 10.

The magnetic particles 38 may, for example, be ferro- or ferri-magnetic particles, or (super)paramagnetic particles, comprising, for example, elements such as cobalt, nickel, iron, ferrites. In embodiments, the magnetic particles 38 may be superparamagnetic particles, i.e. they do not have a remanent magnetic field when an applied magnetic field has been switched off, especially when elastic recovery of the polymer is slow compared to magnetic field modulation. Long off-times of the magnetic field may save power consumption.

During deposition, a magnetic field may be used to move and align the magnetic particles 38, such that the net magnetization is directed in the length-direction of the magnetic actuator element 30.

The application of a magnetic field to the magnetic actuator elements 30 may then result in translational as well as rotational forces to the actuator elements 30. The translational force equals:

$$\vec{F}=\nabla(\vec{m}\cdot\vec{B}) \quad (1)$$

wherein $\vec{m}$ is the magnetic moment of the magnetic actuator element 30 and wherein $\vec{B}$ is the magnetic induction.

Figure 11:
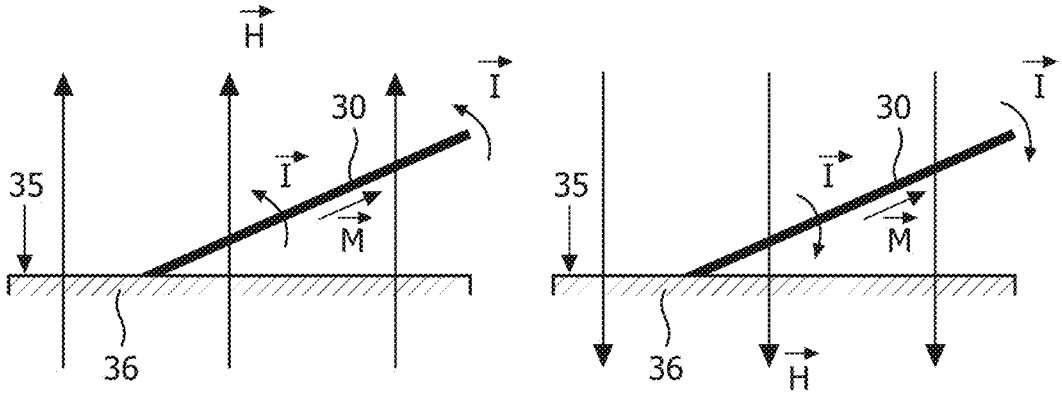
FIG. 11 illustrates the application of a uniform magnetic field on a straight polymer actuator element, according to an embodiment of the present invention.

The rotational force, i.e. the torque on the magnetic actuator element 30, will cause it to move, i.e. to rotate, and/or to change shape. This is illustrated in FIG. 11 for a static, uniform magnetic field applied to the magnetic actuator elements 30 by an external magnetic field generating means such as, for example, an electromagnet or a permanent magnet adjacent the micro-fluidic system, or an internal magnetic field generating means such as, for example, conductive lines integrated in the micro-fluidic system.

Assuming, for example, a magnetic field applied by an external magnetic field generating means, the actuator element 30 having a magnetic moment $\vec{m}$ and a magnetic field strength $\vec{H}$, then the torque $\vec{\tau}$ acting on the actuator element 30 may be given by:

$$\vec{\tau}=\mu\vec{m}\times\vec{H}=\vec{m}\times\vec{B}=V\vec{M}\times\vec{B}=LwtM\times\vec{B} \quad (2)$$

wherein $\mu$ is the permeability of the material, $\vec{B}$ is the magnetic induction, $\vec{M}$ is the magnetization (i.e. the magnetic moment per unit volume), and V is the volume of the actuator element 30, L being the length, w being the width and t being the height of the actuator element 30. Obviously, the applied torque depends on the angle between the magnetic moment and the magnetic field, and it is zero when these are aligned. In the situation sketched in FIG. 11, the approach of the completely erected state will go slower and slower as the angle between the magnetic moment $\vec{M}$ and the magnetic field $\vec{H}$ decreases. This may be solved by rotating the magnetic field during the movement of the actuator element 30.

Figure 12:
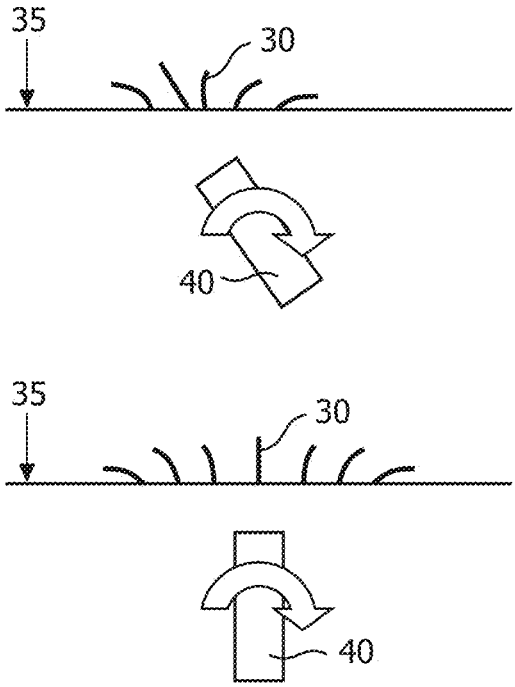
FIG. 12 illustrates the application of a rotating magnetic field to individual polymer actuator elements, according to a further embodiment of the present invention.

A rotating field applied by, for example, a rotating permanent magnet 40, may generate a rotational motion of individual actuator elements 30 and a concerted rolling motion of an array (or a wave) of magnetic actuator elements 30, as schematically illustrated in FIG. 12, which shows the beating stroke. In case of magnetic actuator elements 30 with a permanent magnetic moment, the recovery stroke will occur with actuator element forces oriented towards the surface, so with the actuator elements 30 sliding over the surface rather than through the bulk of the fluid in the micro-channel 33.

To be able to transport fluid through a micro-channel 33 by the movement of the actuator elements 30 positioned at the inner side 35 of the wall 36 of the micro-channel 33, a certain force and/or magnetic moment is required to be applied to the surrounding fluid in the micro-channel 33. In the above discussion it has already been estimated that typical values for the force are about 1 nN, corresponding to a moment of about 10-13 Nm per actuator element 30. The hereinafter-following rough calculation shows that this is indeed achievable with the use of a magnetic field for applying external stimuli to the actuator elements 30, as proposed in this specific embodiment.

If, for example, a magnetic actuator element 30 comprising magnetic particles 38, as illustrated in FIG. 10, and the following realistic parameters, as summarized below in Table 1, are assumed,

TABLE 1

| Parameter | value |
|---|---|
| Magnetic induction B | 10 mT |
| Saturation magnetization of the magnetic material $M_b$ | $5\times10^5$ A/m |
| Length of actuator element L | 100 μm |
| Width of the actuator element w | 10 μm |
| Thickness of the actuator element t | 3 μm |
| Volume concentration of the magnetic material | 10% |

the net magnetization of the magnetic actuator element 30 may be $M=5\times10^4$A/m. Using equation (2), the maximum torque applied to the polymer actuator element 30 may be calculated. Assuming the magnetization direction and the direction of the magnetic field are substantially perpendicular to each other, the torque $\tau$ may be $15\times10^{-13}$ Nm. The maximum force is then $F=\tau/L=15$ nN. Compared to the required force and moment given as described above, it is clear that it is possible to easily obtain the required values using magnetic actuation, as described in the present specific embodiment.

Figure 13:
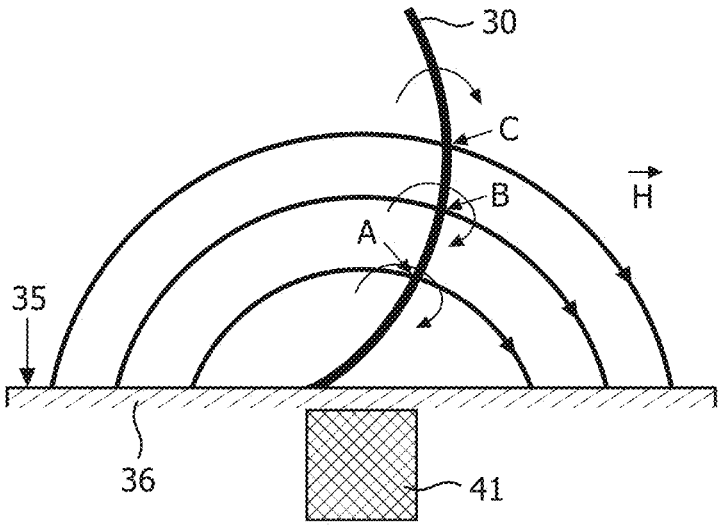
FIG. 13 illustrates the application of a non-uniform magnetic field using a conductive line to apply a torque on a polymer actuator element according to a further embodiment of the present invention.

Instead of using an external magnetic field generating means such as a permanent magnet or an electromagnet that can be placed outside the micro-fluidic system as described above, another possibility is to use conductive lines 41 that may be integrated in the micro-fluidic system. This is illustrated in FIG. 13. The conductive lines 41 may, for example, be copper lines with a cross-sectional area of, for example, 100 $\mu m^2$, with which magnetic flux densities of 10 mT may be easily induced. The magnetic field generated by a current through the conductive line 41 decreases with 1/r, r being the distance from the conductive line 41 to a position on the actuator element 30. For example, in FIG. 13, the magnetic field will be larger at position A than on position B of the actuator element 30. Similar, the magnetic field at position B will be larger than the magnetic field on position C of the actuator element 10. Hence, $\vec{H}_1>\vec{H}_2>\vec{H}_3$. Therefore, the polymer actuator element 30 will experience a gradient in magnetic field along its length L. This will cause a "curling" motion of the magnetic actuator element 30, on top of its rotational motion. It can thus be imagined that, by combining a uniform magnetic "far field", i.e. an externally generated magnetic field which is constant over the whole actuator element 30, the far field being either rotating or non-rotating, with conductive lines 41, it may be possible to create complex time-dependent magnetic fields that enable complex moving shapes of the actuator element 30. This may be very convenient, in particular for tuning the moving shape of the actuator elements 30 so as to get an optimized efficiency and effectiveness in fluid control. A simple example may be that it would enable a tunable asymmetric movement, i.e. the "beating stroke" of the actuator element 30 being different from the "recovery stroke" of the actuator element 30.

The movement of the actuator elements 30 may be measured by, for example, one or more magnetic sensors positioned in the micro-fluidic system. This may allow to determine flow properties such as, for example, flow speed and/or viscosity of the fluid in the micro-channel 33. Furthermore, other fluid details may be measured by using different actuation frequencies. For example, the cell content of the fluid, for example the hematocriet value, or the coagulation properties of the fluid, could be measured in that way.

An advantage of the above embodiment is that the use of magnetic actuation may work with very complex biological fluids such as e.g. saliva, sputum or full blood. Furthermore, magnetic actuation does not require contacts. In other words, magnetic actuation may be performed in a contactless way, i.e. when external magnetic field generating means are used, the actuator elements 10 themselves are inside the micro-fluidic cartridge while the external magnetic field generating means are positioned outside the micro-fluidic cartridge.

It is to be understood that although preferred embodiments, specific constructions and configurations, as well as materials, have been discussed herein for devices according to the present invention, various changes or modifications in form and detail may be made without departing from the scope and spirit of this invention. For example, other ways for creating motion than creating "ciliary movement" as described above are also disclosed by the present invention. For example, the change in shape and/or orientation of the actuator elements 30 may lead to a distributed drive of liquid present in the micro-channels 33 of a micro-fluidic system. This could then be modified to be used as a pump. One way of doing this may be to use electroactive polymer gels, e.g. polyacrylic acid gel, or Ionomeric Polymer-Metal Composite (IMPC) materials, or e.g. perfluorcarbonate or perfluorsulfonate, to form actuator elements 30 which are attached to an inner side 35 of a wall 36 of a micro-channel 33. Sequential addressing of such actuator elements 30 by means of external stimuli means could cause a wave ripple for driving a liquid in one direction in the micro-channel 33. The external stimuli means may, for example, be an electrical field generating means. In that case and in case of electroactive polymer gel actuator elements 30, for example, one or more electrodes, e.g. conducting polypyrrole electrodes, can be incorporated in the gel actuator elements 30. Sequential addressing of the one or more electrodes in the electroactive polymer gel actuator elements 30 then causes the actuator elements 30 to sequentially change shape and/or orientation, hence causing a wave ripple.

The invention claimed is:

1. A micro-fluidic system comprising:

at least one micro-channel having a wall with an inner side;

a plurality of ciliary actuator elements attached to said inner side at substantially opposite positions, each ciliary actuator element including first and second shapes having different dimension, and an orientation, the first and second shapes are selectable from at least curled and straight; and a unit for applying stimuli to said plurality of ciliary actuator elements to change the shape and/or dimension, and the orientation.

2. The micro-fluidic system according to claim 1, wherein the plurality of ciliary actuator elements are polymer actuator elements.

3. The micro-fluidic system according to claim 2, wherein the polymer actuator elements comprise a polymer Micro-Electro-Mechanical System (MEMS).

4. The micro-fluidic system according to claim 1, wherein said unit for applying a stimulus to said plurality of ciliary actuator elements is selected from one of an electric field generator, an electromagnetic field generator, an electromagnetic radiation generator, a magnetic field generator or a heating generator.

5. The micro-fluidic system according to claim 1, wherein said unit for applying a stimulus to said ciliary actuator elements is a magnetic field generator.

6. The micro-fluidic system according to claim 5, wherein said ciliary actuator elements comprise one of a uniform continuous magnetic layer, a patterned continuous magnetic layer, and magnetic particles.

7. The micro-fluidic system according to claim 1, wherein said plurality of ciliary actuator elements is arranged in a first and a second row, said first row of ciliary actuator elements being positioned at the first position of said inner side of said wall and said second row of ciliary actuator elements being positioned at the second position of said inner side of said wall.

8. The micro-fluidic system according to claim 1, wherein said plurality of ciliary actuator elements are arranged in a plurality of rows forming a two-dimensional array.

9. The micro-fluidic system according to claim 1, wherein said plurality of ciliary actuator elements are randomly arranged at the inner side of the wall.

10. A method for controlling a fluid flow through a micro-channel of a micro-fluidic system, the micro-channel having a wall with a inner side, the method comprising acts of:

providing a plurality of ciliary actuator elements at substantially opposite positions, the ciliary actuator elements each including first and second shapes having different dimension, and an orientation, the first and second shapes are selectable from at least curled and straight; and applying a stimulus to said plurality of ciliary actuator elements change the shape and/or dimension, and the orientation.

11. The method according to claim 10, wherein the stimulus is a magnetic field.

12. The micro-fluidic system of claim 1, used in at least one of biotechnological, pharmaceutical, electrical or electronic applications.

13. A micro-fluidic system comprising:

at least one micro-channel haying a wall with an inner side and containing a liquid, a plurality of electroactive polymer actuator elements attached to said inner side at substantially opposite positions, each electroactive polymer actuator element including first and second shapes having a different dimension, the first and second shapes are selectable from at least curled and straight; and a unit for applying stimuli to one or more of said plurality of electroactive polymer actuator elements to change the shape and dimension to drive the liquid in a direction along the micro-channel.

14. The micro-fluidic system according to claim 13, wherein said plurality of electroactive polymer actuator elements comprises a polymer gel or an Ionomeric Polymer-Metal Composite.

* * * * *